US006669533B2

(12) United States Patent
Huboud-Peron

(10) Patent No.: US 6,669,533 B2
(45) Date of Patent: Dec. 30, 2003

(54) RAIL PROFILE GRINDING MACHINE

(75) Inventor: Maurice Huboud-Peron, La Tour du Pin (FR)

(73) Assignee: Societe Turripinoise de Mecanique SA, Saint Didier de la Tour (FR)

( * ) Notice: Subject to any disclaimer, the term of this patent is extended or adjusted under 35 U.S.C. 154(b) by 0 days.

(21) Appl. No.: 09/911,533

(22) Filed: Jul. 25, 2001

(65) Prior Publication Data

US 2002/0019205 A1 Feb. 14, 2002

(30) Foreign Application Priority Data

Aug. 1, 2000 (FR) ..... 00 10160

(51) Int. Cl.[7] ..... B24B 49/00
(52) U.S. Cl. ..... 451/11; 451/24; 451/347
(58) Field of Search ..... 451/11, 347, 24, 451/344, 429, 439

(56) References Cited

U.S. PATENT DOCUMENTS

| | | | | | |
|---|---|---|---|---|---|
| 1,772,636 | A | * | 8/1930 | Re Qua et al. | 451/127 |
| 2,118,621 | A | | 5/1938 | Perazzoli | |
| 2,148,766 | A | * | 2/1939 | Mall | 451/347 |
| 2,364,879 | A | * | 12/1944 | Talboys et al. | 451/236 |
| 2,378,512 | A | * | 6/1945 | Talboys et al. | 451/1 |
| 3,593,465 | A | * | 7/1971 | Krippes | 451/271 |
| 3,707,808 | A | * | 1/1973 | Danko et al. | 451/347 |
| 3,823,455 | A | * | 7/1974 | Mcllrath et al. | 29/33 R |
| 3,858,361 | A | * | 1/1975 | Behne | 451/194 |
| 3,882,645 | A | * | 5/1975 | Duecker | 451/347 |
| 3,883,323 | A | * | 5/1975 | Cooley | 451/347 |
| 4,205,494 | A | * | 6/1980 | Rivoire | 451/347 |
| 4,396,323 | A | * | 8/1983 | Theurer | 409/296 |
| 4,461,604 | A | * | 7/1984 | Theurer et al. | 409/296 |
| 4,534,689 | A | * | 8/1985 | Theurer | 409/178 |
| 4,779,384 | A | * | 10/1988 | Shoenhair et al. | 451/347 |
| 4,854,088 | A | * | 8/1989 | Clem | 451/28 |
| 5,359,815 | A | * | 11/1994 | Schrunk et al. | 451/347 |
| 5,575,709 | A | * | 11/1996 | Hertelendi et al. | 451/344 |
| 5,735,734 | A | * | 4/1998 | Hertelendi | 451/347 |
| 6,033,166 | A | * | 3/2000 | Hampel | 409/175 |

FOREIGN PATENT DOCUMENTS

| | | |
|---|---|---|
| DE | 4012427 A1 | 4/1990 |
| DE | 195 18 451 A1 | 11/1996 |

* cited by examiner

*Primary Examiner*—M. Rachuba
(74) *Attorney, Agent, or Firm*—Oliff & Berridge, PLC

(57) ABSTRACT

The grinding machine comprises a grinding head with a rotary abrasive tool, carried by a chassis equipped, at its ends, with rollers for running and guiding on the rail that is to be ground. A balancing assembly, resting on the other rail of the track, is mounted to pivot on the chassis, also provided with an orientable maneuvering arm. To rotate the grinding tool, an internal combustion engine is fixed to a support articulated to the balancing assembly, the horizontal output shaft of the engine being connected by a transmission assembly to the grinding head. The machine makes it possible to grind the profile of the head of the rail through an angle of 180° while at the same time avoiding excessive inclination of the engine.

13 Claims, 8 Drawing Sheets

VIII
VIII
37
38
42
41
11
40
36
7
39
4

IX
IX
39
41
40
42
37
38
36
36
7

RAIL PROFILE GRINDING MACHINE

BACKGROUND OF THE INVENTION

The present invention relates to a rail profile grinding machine intended for new work and for maintenance work on railroad tracks and similar runways, particularly in the field of rail transport, mining and handling.

DESCRIPTION OF THE PRIOR ART

A rail profile grinding machine is a machine designed to grind the head of a rail, mainly after it has been welded to form a track, with a view to giving the weld region a profile identical to the profile of the running part of the rail. Usually, rail profile grinding operations affect both the top face of the rail and the two flanks of the rail head, these flanks facing respectively toward the inside and toward the outside of the track.

More specifically, the invention is aimed at improving a rail profile grinding machine of the type comprising a grinding head carrying an abrasive grinding tool mounted to rotate about an axis and capable also of describing an up/down movement parallel to its axis of rotation, the grinding head being carried by a chassis provided, at its ends, with means for running, guiding and fitting on a rail of a railroad track or the like, the grinding machine also comprising motorized means for rotating the grinding tool about its axis and maneuvering means for moving the grinding machine back and forth in the longitudinal direction of the rail that is to be ground, the chassis pivoting with the grinding head about a longitudinal axis so as to provide a choice of grinding the top side of the rail, or the flank of the rail head on the inside of the track or the flank of the rail head on the outside of the track.

In a machine such as this, the chassis and the grinding head carried by the chassis can be inclined at will to one side of the rail or the other, starting from a substantially vertical starting position, so as to allow the top face of the rail or the flanks of the rail head to be ground.

As far as the motorized means for rotating the grinding tool are concerned, certain grinding machines use an internal combustion engine which in itself constitutes a beneficial solution because grinding machines are usually used out of doors where no source of electrical or hydraulic energy is available. Recourse to a combustion engine does, however, pose its own problems, for grinding machines of the kind concerned here.

Hence, in a grinding machine of this kind, produced previously by the applicant, and marketed under the name "MP 12", the combustion engine is carried directly by the chassis, the output shaft of the engine being parallel to the axis of rotation of the grinding tool. What this means is that this engine is inclined with the chassis and the grinding head when these parts are used in an inclined position. Now, the operation of an internal combustion engine is thrown into jeopardy by excessive inclination, which in particular poses problems of carburation and lubrication and may lead to reduced engine life, In another known embodiment described in German patent application No. 19518457, the internal combustion engine is carried by the maneuvering arm of the grinding machine, kept in a vertical plane, and not carried by the chassis of the grinding machine, which means that this engine remains more or less upright, even if the chassis is inclined. However, such an embodiment entails, between the output shaft of the combustion engine and the grinding tool, a complex transmission which is not very reliable and is rather expensive, and which, in the embodiment according to the aforementioned German patent application, comprises, in succession: a flexible shaft, an angle transmission involving bevel gears, a universal joint and a belt.

SUMMARY OF THE INVENTION

The present invention sets out to avoid all these drawbacks by providing a simple and reliable solution to transmitting movement between the combustion engine and the grinding tool, while at the same time limiting the inclination of this engine to small angles, guaranteeing correct operation and longevity of said engine.

Another objective of the invention is to provide a rail profile grinding machine that gives the operator a more ergonomic and less tiring working position To this end, the subject of the invention is essentially a rail profile grinding machine of the kind indicated in the introduction, in which the motorized means for rotating the grinding tool consist of an internal combustion engine with horizontal output shaft, the engine being fixed to a support which is articulated, about a longitudinal axis, to a balancing assembly itself mounted to pivot about a longitudinal spindle on the chassis and designed to occupy, in use, a horizontal position resting on the other rail of the track, while the horizontal output shaft of the engine is connected, via a transmission assembly, to the grinding head carried by the chassis in such a way as to limit the inclination of the engine to small angles.

Thus, the invention proposes a special mounting of the combustion engine, this engine being fixed to a support mounted to pivot, about a horizontal axis, on a balancing assembly itself occupying a position which is invariably horizontal when the grinding machine is in use. The engine is also connected to the chassis via the transmission assembly which, in a preferred embodiment of the invention, comprises a transmission box forming a kind of link, articulated between the output shaft of the engine and a horizontal axis embodied by a spindle connected to the chassis or to the grinding head. Thus, the combustion engine is mounted via an articulated device forming a kind of deformable quadrilateral which is such that the inclination of the pivoting support of the engine, and therefore of the engine itself, with respect to the horizontal remains small and in particular does not exceed about 15°, whereas the chassis carrying the grinding head can be inclined by ±900° to one side or the other with respect to its vertical central position.

Advantageously, spring-loaded means are provided, which act on the pivoting support of the combustion engine to compensate for the weight of this engine. These spring-loaded means, which lighten the load to be exerted by the operator, can be produced in the form of a gas spring or a spring of any other kind, articulated between the balancing assembly and the pivoting support of the engine.

In one embodiment of the invention, the transmission assembly comprises a driving gear wheel carried by the horizontal output shaft of the engine, a toothed belt housed in the transmission box, a receiving gear wheel fixed on the horizontal shaft mounted to rotate about the horizontal axis of articulation of the transmission box to the chassis or the grinding head, and an angular transmission in the form of a pair of bevel gears connecting the latter shaft to a sleeve coaxial with the grinding tool and connected by splines to a shaft carrying the grinding tool.

This then yields a transmission assembly which is simple, lightweight and protected, requires no maintenance and is reliable. Advantageously, in order to input the movement conveniently into the grinding head, the chassis has two offset longitudinal portions, the horizontal shaft mounted along the axis of articulation of the transmission box entering the grinding head at the discontinuity between the two portions of the chassis.

According to another feature, the balancing assembly comprises, on the one hand, a bow connecting the ends of the chassis together and pivoting via its own ends about a longitudinal spindle, relative to this chassis, and, on the other hand, a transverse balancing bar fixed removably to the central part of the bow and provided with a roller or follower designed to press and roll along the other rail of the track. The pivoting support of the engine may be articulated to a yoke, it too fixed in the central part of the bow, some distance from the axis of articulation of the bow on the chassis.

According to yet another feature, given the fact that the chassis of the grinding machine that is the subject of the invention can be inclined by ±90° to one side or the other with respect to its vertical central position, the maneuvering means for the back and forth movement of the grinding machine advantageously comprise an orientable maneuvering arm mounted to pivot about a longitudinal axis on the chassis, means being provided for immobilizing the maneuvering arm in a preselected angular position. The maneuvering arm can thus be oriented by ±45° to each side of a central position, to maintain an ergonomic position of use even if the chassis, which carries this maneuvering arm, is lying down horizontal.

According to a last feature, the chassis of the grinding machine that is the subject of the invention carries, at each end, a set of two guide rollers with parallel axes, mounted on a cowman support itself mounted to rotate about a longitudinal axis relative to the corresponding end of the chassis, on which end is also pivotably mounted one end of the balancing assembly, a connection by way of gears connecting the support of the guide rollers to the end of the balancing assembly and/or to the chassis in such a way that pivoting of this assembly relative to the chassis is accompanied by proportional orientation of the guide rollers. The inclination of the chassis and of the grinding head is thus accompanied by an "automatic" orientating of the guide rollers, which adopt a suitable position depending on whether it is the inside flank or the outside flank of the rail head that is being ground

BRIEF DESCRIPTION OF THE DRAWINGS

In any case, the invention will be better understood with aid of the description which follows, with reference to the appended schematic drawing which, by way of example, depicts one embodiment of this rail profile grinding machine.

DESCRIPTION OF THE PREFERRED EMBODIMENTS

Figure 1:
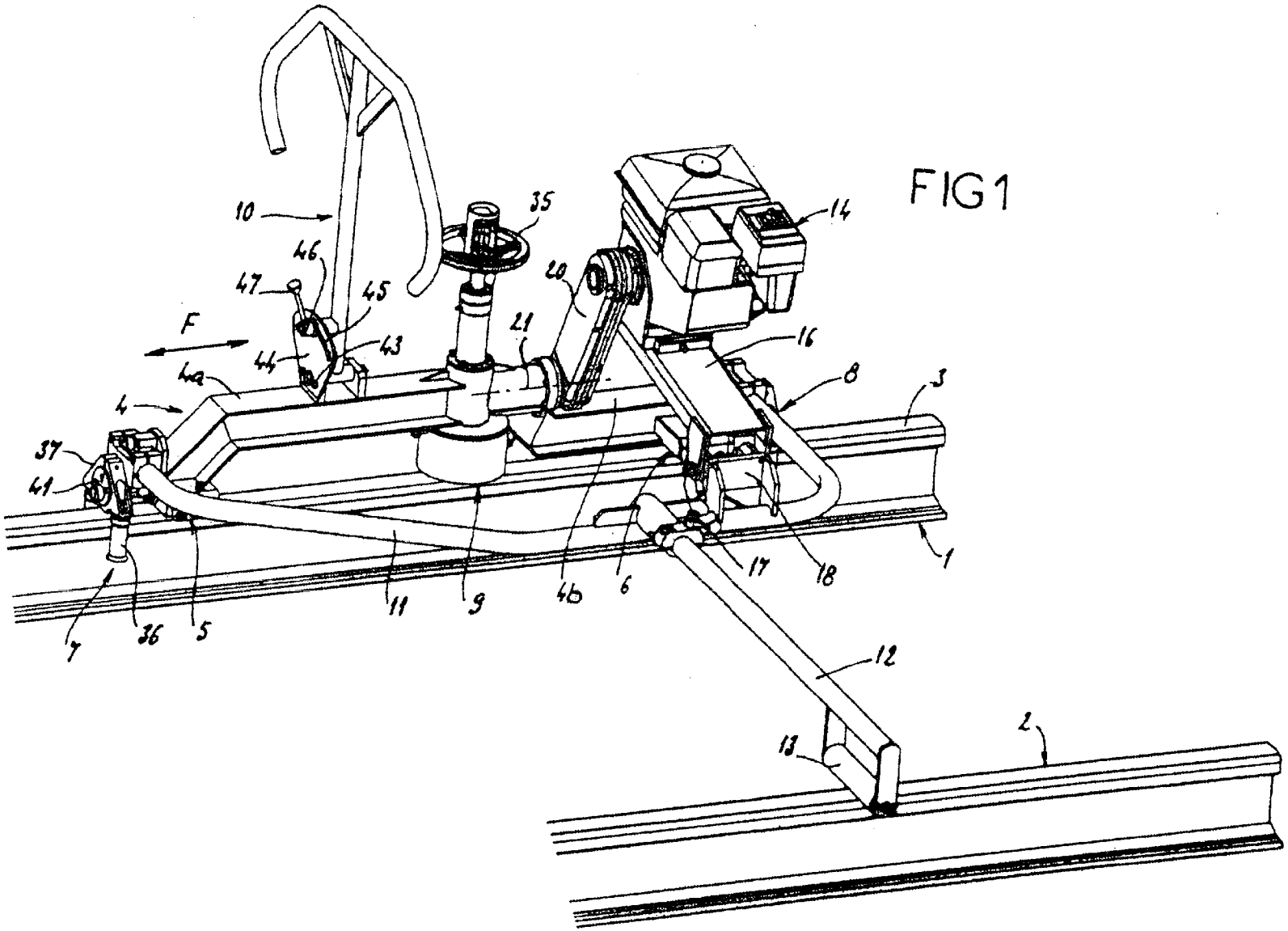
FIG. 1 is an overall perspective view of a grinding machine according to the present invention, in a position for grinding the top of a rail.

As shown in FIGS. 1 to 6, the rail profile grinding machine is intended for work on rails 1 and 2 of a railroad track, and is more particularly designed to profile the head 3 of one of the rails 1 of the track, on which this grinding machine is positioned and guided .

The grinding machine has an elongate chassis 4 which is provided, at its ends, with two sets of three bearing rollers, 5 and 6 respectively. At its ends, the chassis 4 is also provided with two sets of guide rollers, 7 and 8 respectively.

In its central part, the chassis 4 carries a grinding head 9 and an orientable maneuvering art 10.

A bow 11 connects the two ends of the chassis 4, the bow 11 being mounted to pivot about a longitudinal axis with respect to the chassis 4. Fixed removably to the central part of the box 11 is a transverse balance bar 12 provided with a roller or follower 13 at its free end.

Mounted, in a way described in detail below, between the chassis 4 and the bow 11 is an internal combustion engine 14 such a four-stroke conbustion engine intended to rotate an abrasive grinding tool 15 mounted to rotate in the grinding head 9 (see also FIG. 7).

For use, the grinding machine, the general structure of which has just been described, is placed on the track, the chassis 4 being mounted and guided on the rail 1 by the rollers 5, 6, 7 and 8, while the roller or follower 13 rests on the other rail 2. The grinding head 9 is thus positioned facing the head 3 of the rail 1.

The engine 14 is fixed onto a support 16, oriented transversely, which is articulated about a longitudinal axis 17 on a yoke 18 itself fixed to the bow 11, in the central part thereof, some distance from the axis of articulation of the bow 11 to the chassis 4. This engine 14 has a horizontal output shaft 19 oriented longitudinally, and which is connected to a transmission box 20 forming a kind of link, articulated between the shaft 19 and a horizontal axis 21 embodied by a spindle parallel to this shaft 19 and connected to the chassis or the grinding head 9.

A gas spring 22, articulated between the bow 11 and the support 16 (see FIGS. 2, 4 and 6) compensates for the weight of the engine 14 and of its support 16.

The chassis 4 has two offset longitudinal portions 4*a* and 4*b* respectively, the "discontinuity" between the two portions 4*a* and 4*b* allowing the transmission box 20 to be connected along the horizontal axis of articulation 21 facing the end of the first portion 4*a* of the chassis 4.

Figure 7:
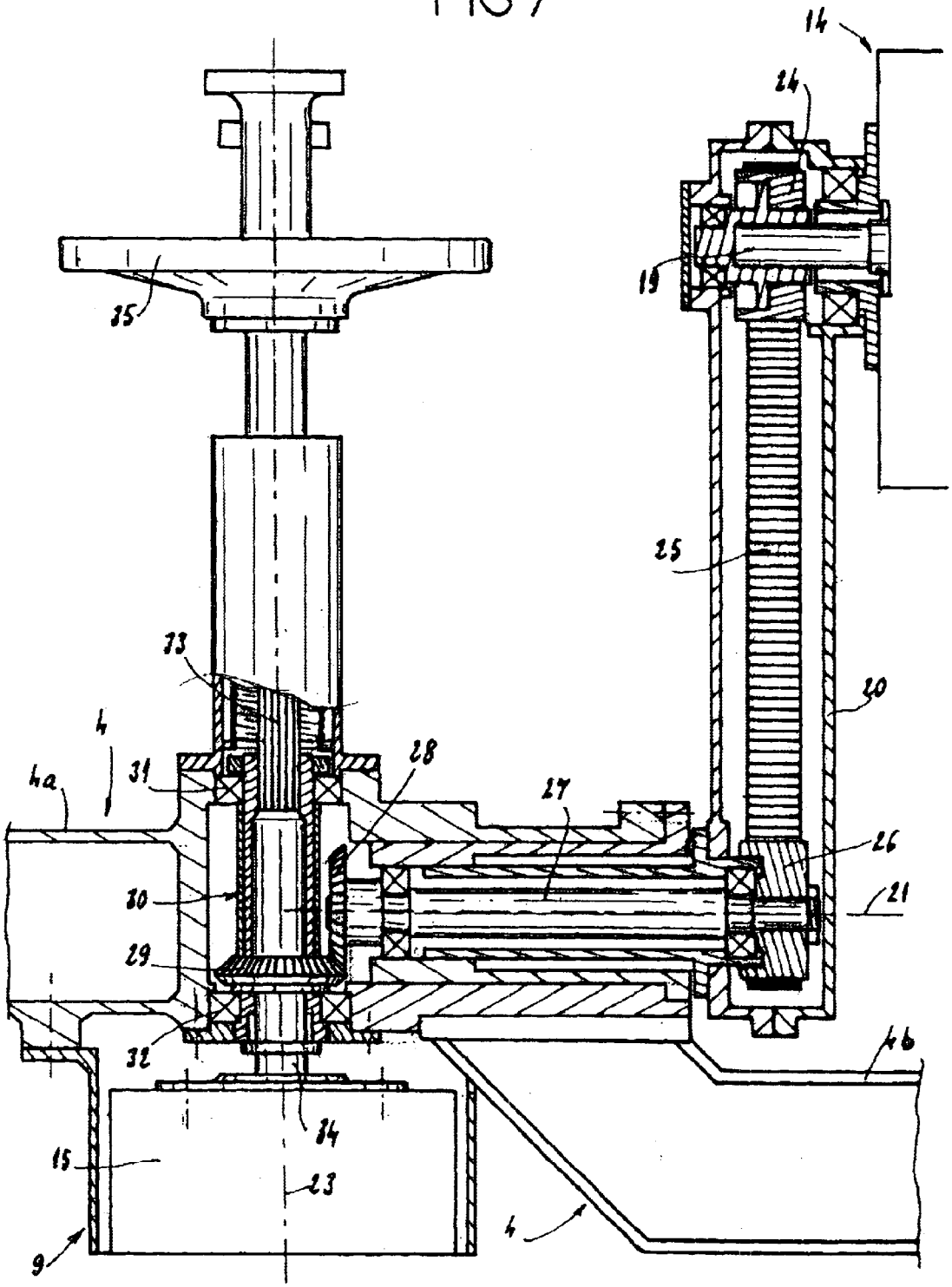
FIG. 7 depicts, in section, a detail of the mechanism that drives this grinding machine.

FIG. 7 shows details of the transmission mechanism for driving, off the engine 14, the rotation of the grinding tool 15 about its axis 23:

The end of the output shaft 19 of the engine 14 which lies inside the transmission box 20 carries a driving gear wheel 24 over which a toothed belt 25 housed in said casing 20 passes. The toothed belt 25 also passes over a receiving gear wheel 26, fixed onto a shaft 27 mounted to rotate about the horizontal axis 21 and entering an angle gear box of the grinding head 9. At its inner end, the shaft 27 carries a bevel gear 28 in mesh with a bevel annulus gear 29 mounted about the axis 23 of the grinding tool 15. The annulus gear 29 rotates as one with a sleeve 30 mounted to rotate about the axis 23 in superposed bearings 31 and 32. The sleeve 30 itself rotates as one with a shaft 34, while having the possibility of sliding axially by virtue of if, splines 33, which shaft 34 carries, at one end, the grinding tool 15. A maneuvering device with a hand wheel 35, with built-in stop, allows the axial position of the shaft 34 and therefore of the grinding tool 15 to be adjusted, the grinding depth thus being adjustable. the two sets of bearing rollers 5 and 6, provided respectively at the ends of the chassis 4, are mounted fixed with respect to the chassis 4 and serve as reference points for grinding, by bearing and running along the surface that is to be ground of the head 3 of the rail 1.

Figure 9:
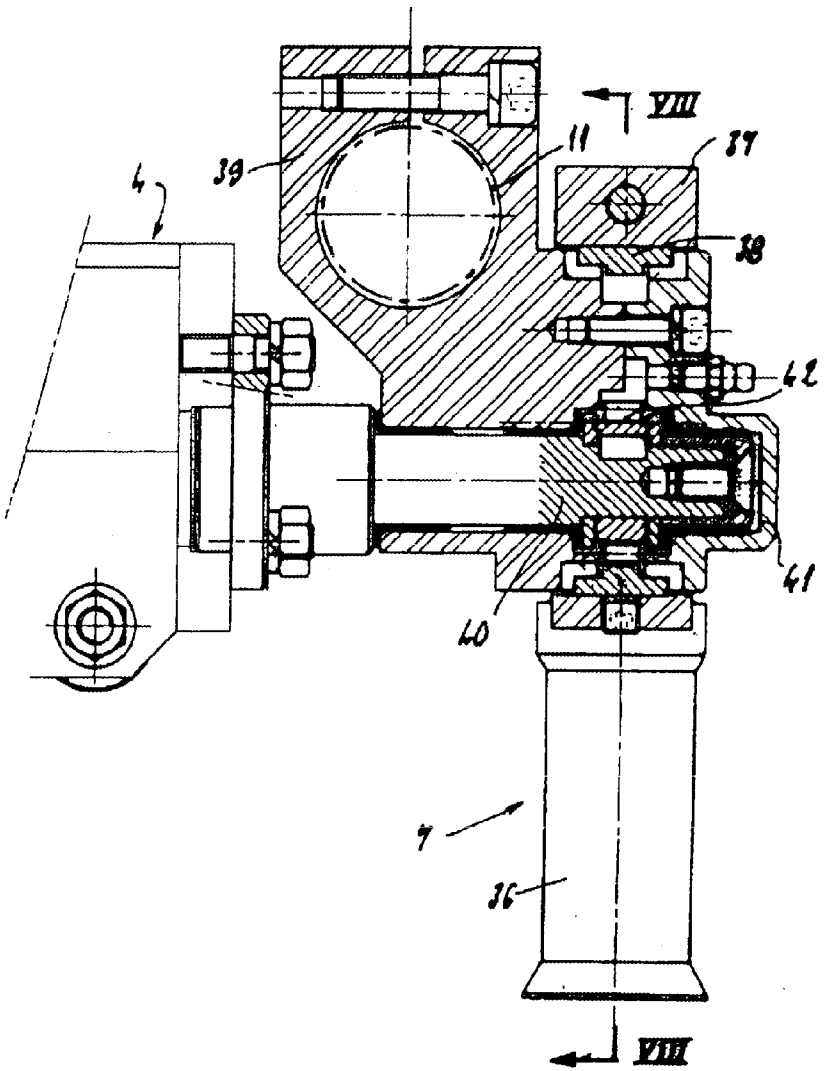
FIG. 9 is a view in section on IX—IX of FIG. 8, corresponding to the same detail.
Figure 8:
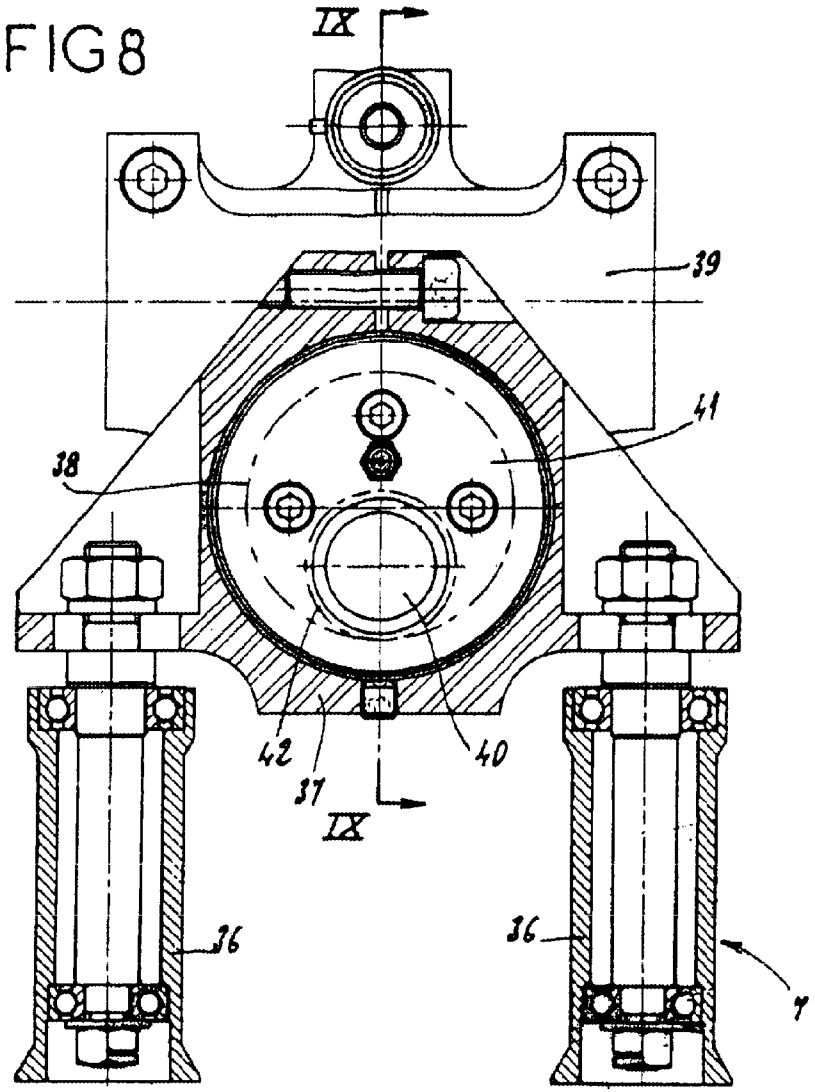
FIG. 8 is a detailed view, in section on VIII—VIII of FIG. 9, showing the detail of the guide rollers and of their mounting.

The two sets of guide rollers 7 and 8 are each mounted to pivot about a longitudinal axis on the corresponding end of the support 4. As shown in greater detail in FIGS. 8 and 9, each set 7 or 8 comprises two guide rollers 36 of parallel axes mounted on a common support 37, the spacing of the two guide rollers 36 being adjustable so as to fit the width of the head 3 of the rail 1. The support 35 has a wide circular opening in which an internally toothed annulus gear 38 is mounted and prevented from rotating.

The corresponding end of the bow 11 is secured to a mounting block 39 which is mounted to pivot about a spindle 40 secured to the end of the chassis 4. The mounting block 39 has a circular hub 41 about which the support 37 is mounted to rotate via its circular opening. In this position, the annulus gear 38 secured to the support 37 comes into mesh with a fixed pinion 42 secured to the spindle 40, the number of teeth on the pinion 42 being equal or substantially equal to half the number of teeth on the annulus gear 38.

Finally, referring once again to FIGS. 1 to 6, the maneuvering arm 10 is mounted to pivot on the first portion 4*a* of the chassis 4 about a longitudinal axis 43 so that it can be adjusted in a transverse plane, and means are provided for immobilizing said maneuvering arm 10 in the selected angular position. These means here comprise a transverse plate 44, secured to the chassis 4 and provided with a slot 45 in the shape of a circular arc, through which a screw secured to the arm 10 passes, onto which screw a locking nut 46 carrying a handle 47 is tightened.

Figure 2:
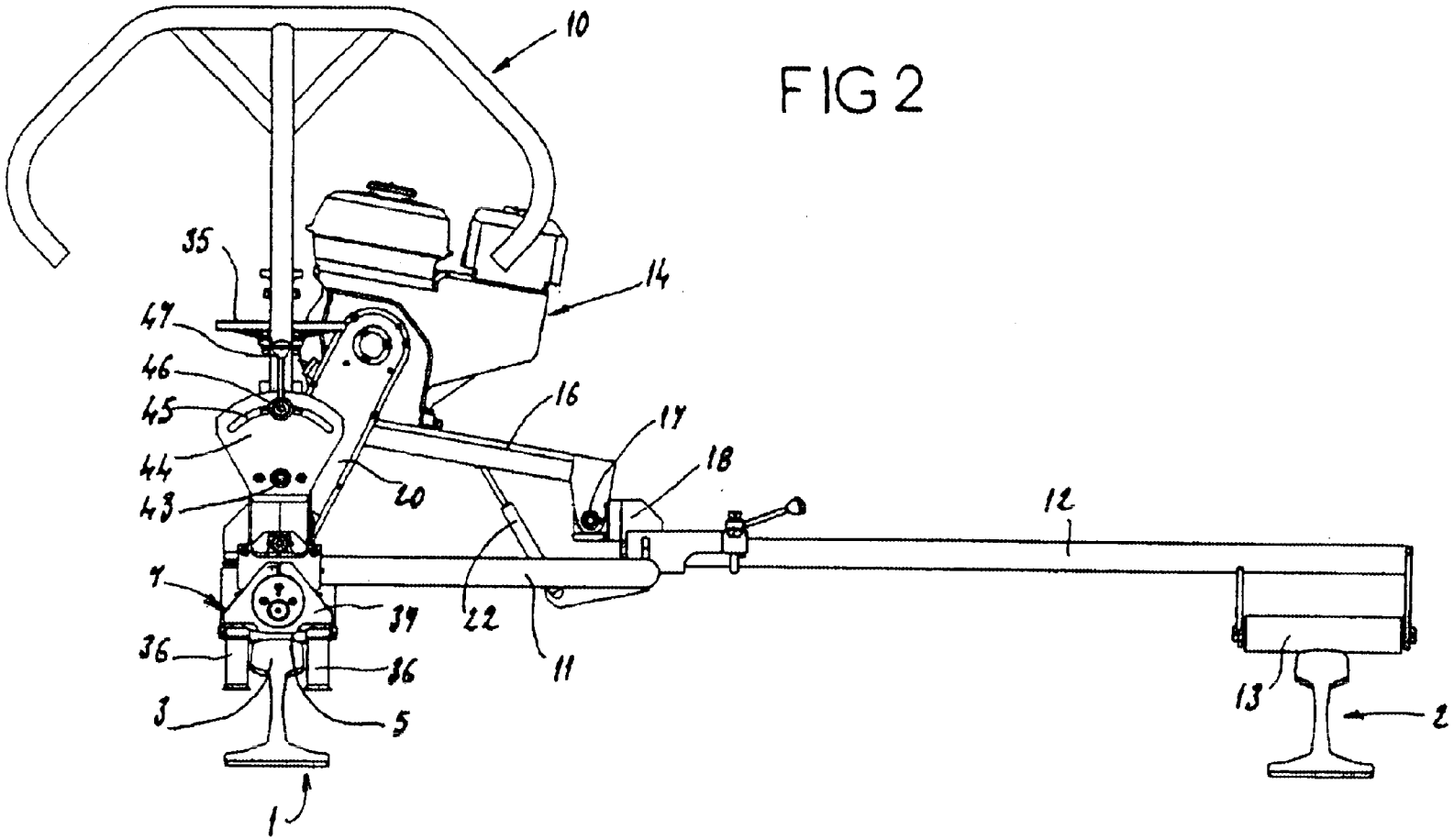
FIG. 2 is an end-on view of the grinding machine in the position of use of FIG. 1.

FIGS. 1 and 2 illustrate the use of the grinding machine described earlier, for grinding the top of the head 3 of the rail 1. For this first use, the positions are as follows:

- The bow 11 and the balance bar 12 lie in a horizontal plane.
- The support 4 lies in a vertical plane above the rail 1 that is to be ground
- The maneuvering arm 10 occupies its central position so that it too is oriented vertically.
- The bearing rollers 5 and 6 all press horizontally onto the top of the rail 1.
- The two guide rollers 36 of each of the two sets 7 and 8 fit vertically on each side of the rail
- The engine 14, with its support 16, has a position with a fairly small inclination with respect to the horizontal.

with the grinding machine in this position, operating the engine 14 and moving the machine back and forth (arrow F) using the maneuvering arm 10 along the track cause the top of the rail 1 to be ground by the tool 15, the rotation of which is driven oft the engine 14.

Figure 3:
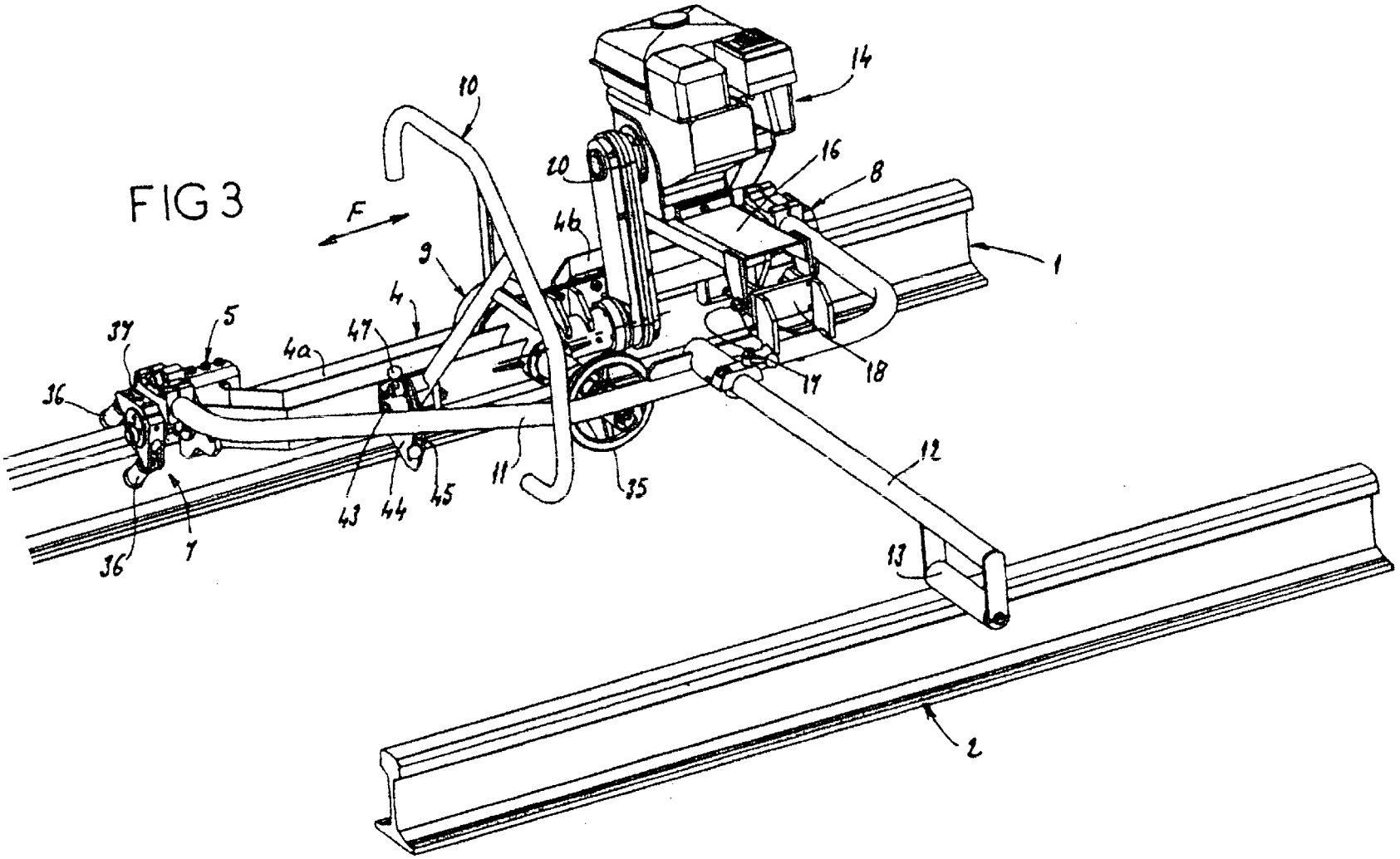
FIG. 3 is an overall perspective view of the grinding machine of the previous figures, in a position for grinding the flank of the rail head, on the inside of the track.
Figure 4:
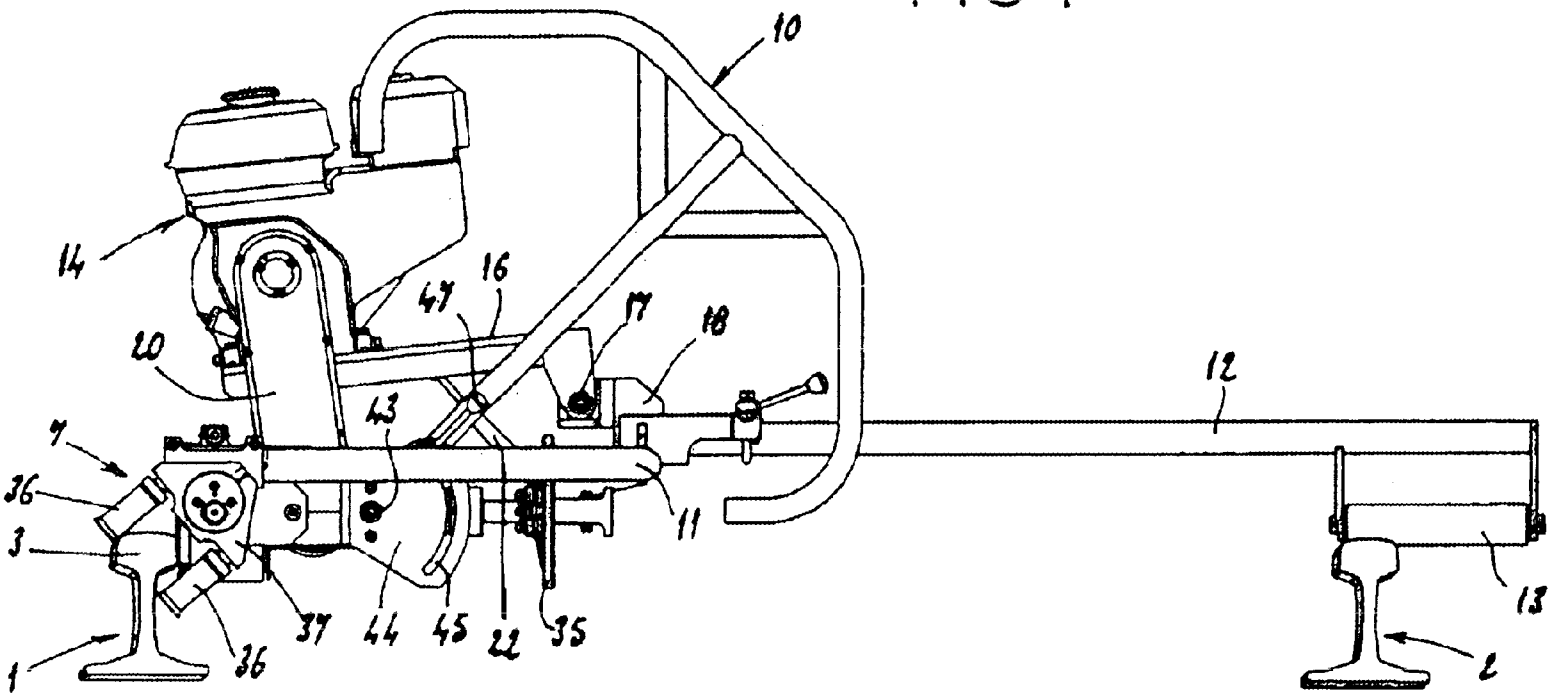
FIG. 4 is an end-on view of the grinding machine in the position of use of FIG. 3.

FIGS. 3 and 4 illustrate the use of the same grinding machine for grinding the flank of the head 3 of the rail 1 facing toward the inside of the track, that is to say the side facing toward the other rail 2. For this second operation, the positions are as follows:

- The bow 11 and the balance bar 12 still lie in a horizontal plane.
- The support 4 too lies in a horizontal plane and is thus oriented toward the other rail 2.
- The maneuvering arm 10 is oriented, with respect to the chassis 4, so that it is raised obliquely.
- The bearing rollers 5 and 6 all press vertically onto the inside flank of the head 3 of the rail 1.
- The two guide rollers 36 of each of the two sets 7 and 8 adopt an oblique orientation, substantially at 450, thus automatically orientating themselves under the effect of the gearing consisting of the annulus gear 38 and of the pinion 42.
- The motor 14, with its support 16, has a practically horizontal position inclined very slightly in the opposite direction to the inclination of the position in FIGS. 1 and 2.

In this other position of the grinding machine, operating the engine 14 and moving the machine back and forth (arrow F) using the maneuvering arm 10, along the track, cause the inside flank of the head 3 of the rail 1 to be ground.

Figure 5:
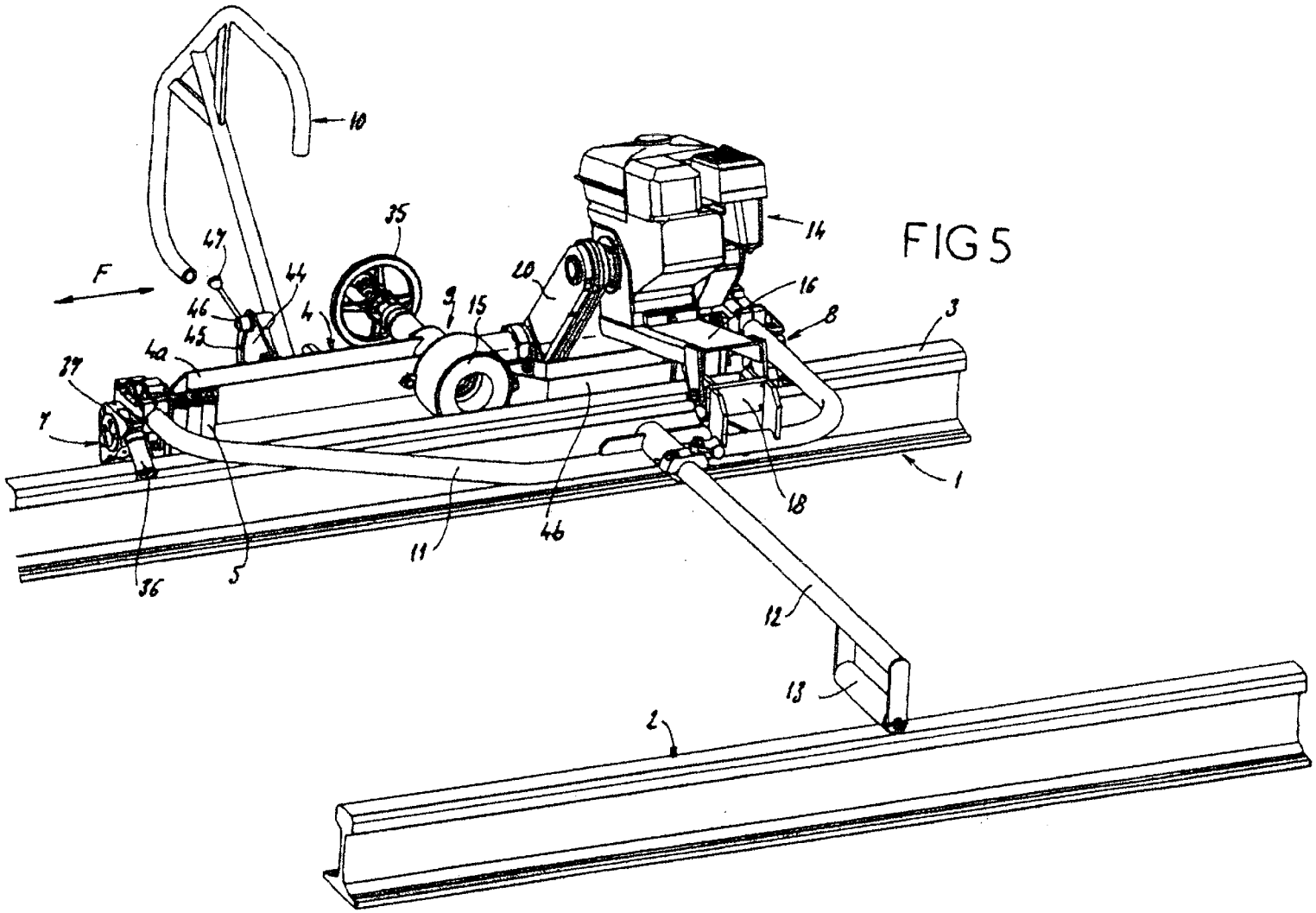
FIG. 5 is an overall perspective view of the grinding machine of the preceding figures, in a position for grinding the flank of the rail head on the outside of the track.
Figure 6:
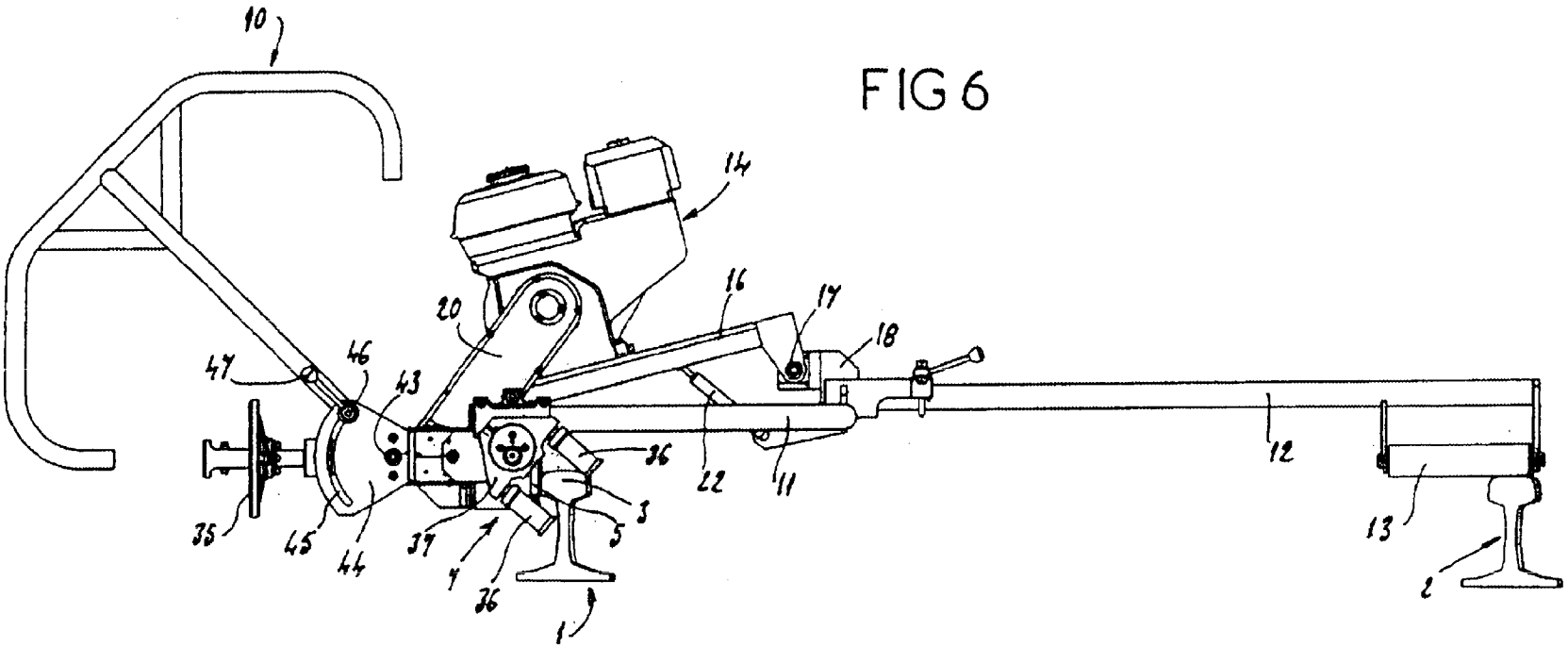
FIG. 6 is an end-on view of the grinding machine in the position of use of FIG. 5.

Finally, FIGS. 5 and 6 illustrate the use of the same grinding machine for grinding the flank of the head 3 of the rail 1 facing toward the outside of the track, that is to say facing away from the other rail 2. For this third use, the positions are as follows:

- The bow 11 and the balance bar 12 still lie in a horizontal position.
- The support 4 too lies in a horizontal plane and is thus oriented away from the other rail 2.
- The naneuvering arm 10 is oriented, with respect to the chassis 4, in the opposite direction to the position of FIGS. 3 and 4, once again to be raised obliquely.
- The bearing rollers 5 and 6 all press vertically onto the outer flank of the head 3 of the rail 1.
- The guide rollers 36 of each of the two sets 7 and 8 adopt an oblique orientation substantially at 45° (but in the opposite direction to that of FIGS. 3 and 4), here too orienting themselves automatically under the effect of the gearing consisting of the annulus gear 38 and of the pinion 42.
- The engine 14, with its support 16, has a practically horizontal position inclined very slightly in the opposite direction to the inclination of the position in FIGS. 1 and 2.

In this last position of the grinding machine, operating the engine 14 and moving the machine back and forth (arrow F), using the maneuvering arm 10, along the track, cause the outer f lank of the head 3 of the rail 1 to be ground.

Of course, it is also possible to bring the grinding machine into intermediate positions, with respect to the three typical positions described above and illustrated in the drawing, in order to grind fillet radii between the top of the rail 14 and the flanks of the rail head 3.

It is apparent from the foregoing that the grinding machine described makes it possible to grind the entirety of the rail head 3, that is to say to grind the profile over an angle of 180° without there being a need to turn the machine over, the maneuvering arm 10 in each case being oriented in such a way as to allow the grinding machine to be operated with ease, and the engine 14 always remaining upright or inclined by a fairly small amount, so that its operation and longevity are guaranteed.

By virtue of the invention, the operator no longer has to support the weight of the engine, has a more ergonomic working position, suffers less vibration and less noise, and is further away from the sparks sprayed.

As goes without saying, the invention is not restricted to the sole embodiment of this rail profile grinding machine which has been described hereinabove by way of example; on the contrary, it encompasses all variant embodiments and variant applications thereof which adhere to the same principle.

Thus, in particular, it would not be departing from the scope of the invention it the exterior shape of the support or the means for mounting the engine so that it pivots or alternatively the details of the bearing rollers and of the guide rollers were modified; the invention extends to the use of sources of motive power other than combustion engines; the machine could be more complex, that is to say be extended so that it drives several grinding machines on one run or two runs of rails, using one or more engines or motors.

What is claimed is:

1. A rail profile grinding machine, comprising a grinding head carrying an abrasive grinding tool mounted to rotate about an axis and capable also of describing an up/down movement parallel to its axis of rotation, the grinding head being carried by the central part of a chassis provided, at its ends, with means for running, guiding and fitting on a rail of a railroad track, the grinding machine also comprising motorized means for rotating the grinding tool about its axis and maneuvering means for moving the grinding machine back and forth in the longitudinal direction of the rail that is to be ground, the chassis pivoting with the grinding head about a longitudinal axis so as to provide a choice of grinding the top side of the rail, or the flank of the rail head on the inside of the track or the flank of the rail head on the outside of the track, wherein the motorized means for rotating the grinding tool consist of an internal combustion engine with horizontal output shaft, the engine being fixed to a support which is articulated, about a longitudinal axis, to a balancing assembly itself mounted to pivot about a longitudinal spindle on the chassis and designed to occupy, in use, a horizontal position by resting on the other rail of the track, while the horizontal output shaft of the engine is connected, via a transmission assembly, to the grinding head carried by the chassis in such a way as to limit the inclination of the engine to small angles.

2. The profile rail grinding machine as claimed in claim 1, wherein the transmission assembly comprises a transmission box forming a link, articulated between the output shaft of the engine and a horizontal axis embodied by a spindle connected to the chassis or to the grinding head.

3. The rail profile grinding machine as claimed in claim 2, wherein the transmission assembly comprises a driving gear wheel carried by the horizontal output shaft of the engine, a toothed belt housed in the transmission box, a receiving gear wheel fixed on a horizontal shaft mounted to rotate about the horizontal axis of articulation of the transmission box to the chassis or the grinding head, and an angular transmission in the form of a pair of bevel gears connecting the latter shaft to a sleeve coaxial with the grinding tool and connected by splines to a shaft carrying the grinding tool.

4. The rail profile grinding machine as claimed in claim 3, wherein the chassis has two offset longitudinal portions, the horizontal shaft mounted along the axis of articulation of the transmission box entering the grinding head at the junction between the two portions of the chassis.

5. The rail profile grinding machine as claimed in claim 1, wherein spring-loaded means are provided, which act on the pivoting support of the combustion engine to compensate for the weight of this engine.

6. The rail profile grinding machine as claimed in claim 5, wherein the aforementioned spring-loaded means are produced in the form of a gas spring articulated between the balancing assembly and the pivoting support of the engine.

7. The rail profile grinding machine as claimed in claim 1, wherein the inclination of the pivoting support of the engine, and therefore of the engine itself, with respect to the horizontal does not exceed about 15°, whereas the chassis carrying the grinding head can be inclined by ±90° to one side or the other with respect to its vertical central position.

8. The rail profile grinding machine as claimed in claim 1, wherein the balancing assembly comprises a bow connecting the ends of the chassis together and pivoting via its own ends about a longitudinal spindle, relative to this chassis, and a transverse balancing bar fixed removably to the central part of the bow and provided with a roller or follower designed to press and roll along the other rail of the track.

9. The rail profile grinding machine as claimed in claim 8, wherein the pivoting support of the engine is articulated to a yoke which is fixed in the central part of the bow some distance from the spindle articulating the bow to the chassis.

10. The rail profile grinding machine as claimed in claim 1, wherein the maneuvering means for the back and forth movement of the grinding machine comprise an orientable maneuvering arm mounted to pivot about a longitudinal axis on the chassis, means being provided for immobilizing the maneuvering arm in a preselected angular position.

11. The rail profile grinding machine as claimed in claim 1, and the chassis of which carries, at each end, a set of two guide rollers with parallel axes, mounted on a common support itself mounted to rotate about a longitudinal axis relative to the corresponding end of the chassis, on which end is also pivotably mounted one end of the balancing assembly, a connection by way of gears connecting the support of the guide rollers to the end of the balancing assembly or to the chassis in such a way that pivoting of this assembly relative to the chassis is accompanied by proportional orientation of the guide rollers.

12. The rail profile grinding machine as claimed in claim 8, wherein each end of the bow is secured to a mounting block mounted to pivot about a spindle secured to the end of the chassis, the mounting block having a circular hub around which the support of the guide rollers is mounted to rotate, which support has a circular opening in which an internally toothed annulus gear meshing with a pinion secured to the spindle, is mounted.

13. The rail profile grinding machine as claimed in claim 11, wherein each end of the bow is secured to a mounting block mounted to pivot about a spindle secured to the end of the chassis, the mounting block having a circular hub around which the support of the guide rollers is mounted to rotate, which support has a circular opening in which an internally toothed annulus gear meshing with a pinion secured to the spindle, is mounted.

* * * * *